US005329273A

United States Patent [19]

Patton

[11] Patent Number: 5,329,273

[45] Date of Patent: Jul. 12, 1994

[54] SYSTEM CONTROLLER AND REMOTE FAULT ANNUNCIATOR WITH COOPERATIVE STORAGE, SHARING, AND PRESENTATION OF FAULT DATA

[75] Inventor: Paul B. Patton, Rockford, Minn.

[73] Assignee: Honeywell, Inc., Minneapolis, Minn.

[21] Appl. No.: 893,167

[22] Filed: Jun. 3, 1992

[51] Int. Cl.[5] ..... G08B 23/00

[52] U.S. Cl. ..... 340/517; 340/501; 340/520; 340/521; 340/525; 431/13

[58] Field of Search ..... 340/517, 518, 521, 525, 340/500, 509, 519, 520, 459, 461; 364/141, 424.03, 424.04; 431/13, 14, 18

[56] References Cited

U.S. PATENT DOCUMENTS

| | | | |
|---|---|---|---|
| 3,967,281 | 6/1976 | Dageford | 340/415 |
| 4,271,402 | 6/1981 | Kastura et al. | 340/518 |
| 4,295,129 | 10/1981 | Cade | 340/520 |
| 4,451,225 | 6/1984 | Landis | 431/14 |
| 4,471,348 | 9/1984 | London et al. | 340/521 |
| 4,642,760 | 2/1987 | Yanai et al. | 364/143 |
| 4,943,919 | 7/1990 | Aslin et al. | 340/525 |
| 5,019,799 | 5/1991 | Oshiage et al. | 340/439 |

FOREIGN PATENT DOCUMENTS

| | | |
|---|---|---|
| 0072270 | 2/1983 | European Pat. Off. . |
| 303855 | 2/1989 | European Pat. Off. . |
| 2566561 | 12/1985 | France . |
| 2115156 | 9/1983 | United Kingdom . |

OTHER PUBLICATIONS

Fireye Bulletin E1001 (Nov. 1988).
Fireye Bulletin E3001 (Sep., 1988).
Fireye Bulletin C610 (Feb., 1980).

*Primary Examiner*—Donnie L. Crosland
*Attorney, Agent, or Firm*—Edward L. Schwarz

[57] ABSTRACT

An annunciator for the conduction status of individual switches wired into a series circuit records this status as status history at regular intervals in a memory. The status history is preferably recorded as individual entries having the identification number of an open switch along with a time stamp specifying the length of time which that switch has been open. The current entry is recorded in the memory and a new entry started each time the switch for which an entry in the memory is being created closes or a switch currently receiving power opens. A controller separate from the annunciator generates a request signal and provides a request time value to the annunciator specifying the time which has elapsed since the request condition was detected. The annunciator uses the request time value to determine the probable switch conduction status at the time of the request.

17 Claims, 3 Drawing Sheets

| INDEX | | |
|---|---|---|
| 0 | ID NO | TIME |
| 1 | ID NO | TIME |
| 2 | ID NO | TIME |
| 3 | ID NO | TIME |
| 4 | ID NO | TIME |
| 5 | ID NO | TIME |
| 6 | ID NO | TIME |
| 7 | ID NO | TIME |
| 8 | ID NO | TIME |
| 9 | ID NO | TIME |
| 10 | ID NO | TIME |
| 11 | ID NO | TIME |
| 12 | ID NO | TIME |
| 13 | ID NO | TIME |
| 14 | ID NO | TIME |
| 15 | ID NO | TIME |

SYSTEM CONTROLLER AND REMOTE FAULT ANNUNCIATOR WITH COOPERATIVE STORAGE, SHARING, AND PRESENTATION OF FAULT DATA

BACKGROUND OF THE INVENTION

Many types of control systems are used to operate apparatus which has the potential for causing harm or injury if various parameter levels are outside of predetermined ranges. A simple example is the automobile whose engine will be severely damaged if the oil pressure is too low or the coolant temperature is too high. In this situation the system relies on the good judgment of the driver to stop the auto as soon as the warning light or gauge indicates the problem. In some systems too, it is desirable to simply monitor operation of various aspects of a system.

In many of these systems however, human monitoring of the apparatus parameters may be unacceptable because the apparatus is intended to operate automatically, or because the result of improper, that is to say human, monitoring may result in serious damage or injury. Neither is it desirable to rely on the control system to monitor every one of these parameter levels and shut down the system when needed because this adds substantial complexity to the controller. Also, the control system can on occasion fail, for example because of power outages. Instead, in most systems these parameters are used to directly control interlock switches which open if the parameter level is outside of the predetermined range. In these systems, the interlock switches are typically arranged in a series circuit which passes the current for operating the apparatus (and parts of the control system as well in many cases) so that if any of the parameter levels are outside the range specified for it, the apparatus will not receive power and cannot operate. Examples of these series circuits of interlock switches are found in a number of different types of apparatus and their controls, including as one example burner systems and controls. In burner controls, the interlock switch series circuit is used to control power which operates the fuel valves. If any of the burner system parameters are outside the specified ranges, power is not available to the fuel valves, with the result that the burner cannot operate.

One problem which arises in these systems is determining the cause of a malfunction. If an interlock switch opens, power to the system is interrupted of course, but the problem can be in any of the parameters controlling the interlock switches or in other aspects of the system. For example, in burner systems flame failure does not control an interlock switch. In this particular situation, the control system itself interprets the flame sensor signal and shuts down the fuel valves when flame is detected as absent. When the shutdown is caused by an open interlock switch, by the time a repairer arrives to correct the problem, the original cause of the shutdown may no longer exist. As one example of this situation, a low fuel pressure parameter which opens an interlock switch may have been restored within a few seconds and thus will not be apparent to the repairer. Even when latching interlock switches are used, on occasion a second fault may occur after the first fault and before the diagnostic procedures can be started. It is then difficult to determine the cause of the original shutdown. Early annunciators for use with these switch strings simply showed current status of the switches, which was not always adequate for easy troubleshooting.

In order to simplify and improve troubleshooting of malfunctions in these systems, improved annunciators have been designed which record the status of each of the interlock switches in the interlock switch string at the time a fault is detected. Thus for example, U.S. Pat. No. 4,295,129 (Cade) describes a circuit connected to individual interlock switches and the main and pilot valve actuators, to detect abnormal conditions by sensing the status of the fuel valves and to record the identity of the first interlock switch or fuel valve to open at the time the abnormal condition was detected. U.S. Pat. No. 3,967,281 (Dageford) attempts to determine the earlier of two detected failures and record the identity of the switch which first opened. These will typically be related, but may happen in either order, and an indication of the earlier allows easier detection of the underlying problem.

Frequently, knowledge of the current status is helpful during troubleshooting. A problem with the present systems is that it is not possible during troubleshooting, without losing the first out status, to determine the current status of the switches without individually testing or inspecting them. While such individual testing or inspecting is possible, it is laborious when a large number of switches are involved. Furthermore, the current states of these switches may change during the troubleshooting, resulting in further troubleshooting problems.

It frequently is undesirable to build a high level first out fault detection directly into the controller for the system. There may be system configuration advantages in separating the switch status annunciator functions from the control functions. For example, the interlock switches may be physically located at some distance from the controlled system. Or the control system may have a deliberate modular design to accommodate users who may not need a high level of fault detection. In such systems, it is frequently convenient to use a simple serial communication path between the annunciator and the controller. Such a communication path is easy to install, and the transceivers which implement its use are cheap and allow reliable communication. Frequently, such a path will be shared by a number of modules, say other controllers, if a number of independent systems are involved, or a display module which may have yet a third physical location.

In such a system, fault detection, as opposed to switch status information, is still typically included in the controller, since this dramatically improves the reliability and speed of the controller in responding to fault conditions as they occur. However, the use of a shared serial communication path means that the annunciator for a particular interlock switch series circuit may not receive notification of a fault until some time after the fault has actually occurred. Since this time between fault detection and notification to the annunciator may be appreciable in certain instances, say on the order of hundreds of milliseconds, switch status may have changed and the first out information then provided by the annunciator will be incorrect. Inaccurate first out information has the potential to dramatically worsen the problem of fault diagnosis. Accordingly, there is a motivation to improve the accuracy of first out information provided in the situation described.

There are also situations where switch status may be desired even though a fault has not occurred. For example, during startup or shutdown of an installation, switches in a series circuit may be scheduled to close or open at particular stages, and certain installations may find it useful to log this information even though no fault has been sensed.

CROSS REFERENCE TO RELATED APPLICATIONS

The following U.S. applications have a common filing date and assignee with this application:

"Display Panel Associating Series Circuit Interlock Switch Conduction Status Indicators with Circuit Topology", Ser. No. 07/893,177 Paul Patton and Gregory Merten, applicants.

"Display Apparatus for a First Out Type of Fault Status Annunciator Having a Series String of Interlock Switches", Ser. No. 07/893,166 Paul Patton and Gregory Merten, applicants.

BRIEF DESCRIPTION OF THE INVENTION

In order to comprehensively determine the status of a series switch circuit, I have determined that it is necessary to keep a history identifying the status of a switch, which most frequently will be the first out switch, at each instant of recently elapsed time. I use a status recorder for recording the status history of at least one of a plurality of interlock switches each having a pair of contacts, where said contacts are connected by a plurality of conductors to form a series circuit of interlock switches in a preselected sequence. The series circuit is connected to pass current from a power source to a load. The status recorder includes a plurality of voltage sensors each associated with an interlock switch. Each voltage sensor is connected to a conductor connected to the interlock switch with which the voltage sensor is associated and provides a status signal having a first state responsive to presence of power voltage on the conductor to which it is connected and a second state otherwise.

The status recorder further comprises a) signal selector means receiving the status signals for providing a selector signal encoding the status of at least one selected interlock switch;

b) a status register receiving the selector signal and a status change signal, recording the information encoded in the selector signal responsive to the status change signal, and providing a status register signal encoding the contents of the status register;

c) an oscillator issuing a clock signal having level changes at preset intervals;

d) a counter receiving the clock signal, changing an internally stored time stamp value by a fixed amount responsive to each level change in the clock signal, and providing a time stamp signal encoding the time stamp value;

e) status change sensing means receiving the selector signal from the signal converter and the status register signal for comparing the information encoded in the selector signal and the status register signal, and responsive to disagreement therebetween, providing the status change signal; and f) a memory receiving the status change signal, the status register signal, and the time stamp signal, for sequentially recording responsive to each status change signal, a history entry comprising the information encoded in the status register signal and the time stamp value encoded in the time stamp signal, and for providing a history signal encoding recorded history entries.

The information most often of interest and also most easily determined is the identity of the first out switch. The status recorder described above may be modified to record first out information by assigning to each of said interlock switches a unique identification number. Further, each voltage sensor has assigned to it the identification number of its associated interlock switch. The signal selector means comprises a signal converter receiving the status signals from the voltage sensors. The signal converter provides as the selector signal a first out signal encoding the identification number of an interlock switch with which is associated a voltage sensor currently providing a status signal having the second state and connected to the contact of a switch also having a contact connected through a conductor to a voltage sensor providing a status signal having the first state. The status register comprises a first out register recording the identification number encoded in the status signal. The memory comprises means recording the identification number encoded in the first out register signal. Of course, the time stamp value is recorded with each of the history entries encoding the first out identification number.

A system which can interpret and use the switch status information of the history signal and which includes the modified status recorder described in the paragraph above has in the status recorder a memory including a plurality of storage locations, each storage location recording a single history entry. The system further comprises a controller including i) request means for providing a request signal responsive to a preselected controller condition and ii) a request timer holding a frequently updated request time value specifying the time currently elapsed since the request signal was provided and providing a request time signal encoding the current request time value. Because of the data transmission protocols involved as explained earlier, the status recorder in such a system may well not receive a request signal for some time after the request has actually occurred.

In this system, the status recorder cooperates with an analyzer comprising a) a delay timer receiving the request time signal and updating a delay time value at the rate of the request timer, and providing a transmit delay time signal encoding a transmit delay time value equalling at least the sum of the delay time value and the request time value; and b) entry selection means receiving the transmit delay time signal and the history entries encoded in the history signal, for selecting on the basis of a comparison of the time stamp values in the history entries with the transmit time delay value, at least one history entry recorded in the memory and for providing the identification number recorded therein as a first out signal responsive to said provided identification number equalling one of a preselected set of identification number values.

DESCRIPTION OF THE PREFERRED EMBODIMENT

Figure 1:
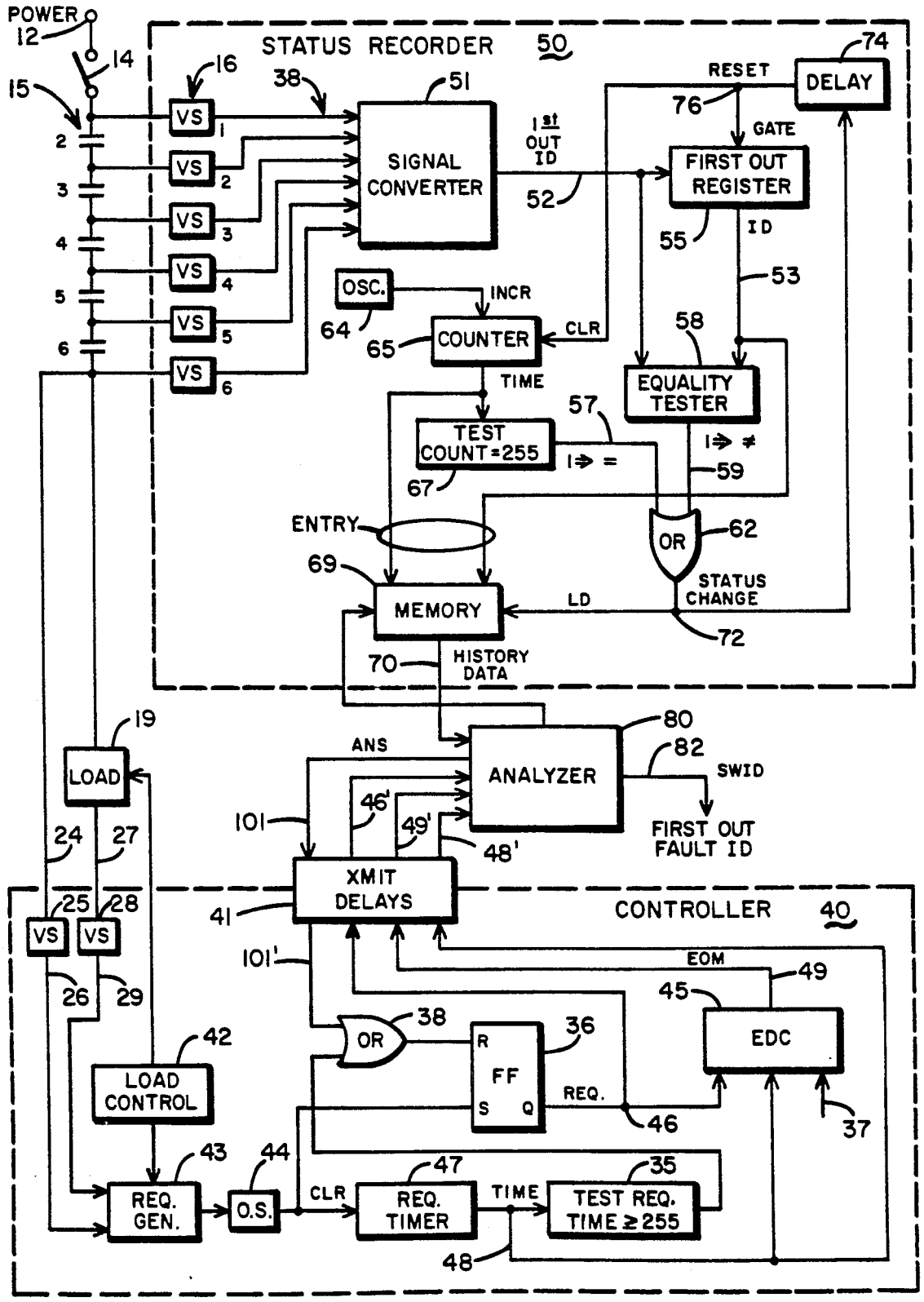
FIG. 1 is a block and logic diagram of the status recorder and a controller which requests the status information recorded by the status recorder.

Turning first to FIG. 1, a system which is to be controlled is shown as comprising a load 19 which receives its operating power from a power source 12 through series circuit comprising a master switch 14 and other interlock switches shown generally at 15. Each interlock switch includes a pair of contacts by which individual conductors connect the switches to form the series circuit. The interlock switches 15 are given unique identification numbers by which they are specified, and exemplary identification numbers have been written just to the left of each of them. While only six switches are shown in this embodiment, many systems may use a dozen or more.

The conduction status of each of the interlock switches is generally controlled by a physical parameter which must fall within a certain range for safe operation of the load either before or during the load startup operations. For example, if the load is a burner, certain of the interlock switches will be controlled by parameters associated with the burner's fuel supply. If the parameter is fuel pressure which becomes too low or high at any time then one of the switches in the series circuit 15 will open. If a combustion air fan fails to operate during startup, then an air flow sensor causes an interlock switch in series circuit 15 to remain open. In the burner example, the load may comprise the fuel valves and ignition needed for proper operation. It can be seen that the function of series circuit 15 and the parameters associated with their operation serve to prevent operation of the load if not safe to do so.

One can see that the interlock switch closest in the series circuit 15 to the power terminal and which is open, will have power voltage on one of its contacts only, and that all of the conductors between that contact and the power terminal will also carry power voltage. Conversely, none of the other conductors will carry power voltage. It is conventional to refer to the open interlock switch which is the open switch closest to the power terminal 12 as the first open or first out switch.

Voltage sensors 16 receive on their input terminals the voltage present at the connectors between adjacent pairs of contacts of interlock switches in the series circuit 15. Each of the voltage sensors 16 provides on one of the output paths 38 a status signal having first and second states accordingly as voltage is absent or present on the connector to which its input terminal is connected. The status signals will reveal the first out switch, by each having second states where the voltage sensors are connected to conductors between the first out switch and the power terminal, and first states otherwise. The individual voltage sensors 16 are also identified by individual identification numbers place adjacent to each and related to the interlock switches' identification numbers, such that each voltage sensor is connected to the conductor attached to the downstream (from the power terminal 12) contact of the switch having that identification number.

Other than voltage sensors 16, all of the individual elements shown in status recorder 50 will usually comprise a suitable programmed microprocessor. (By "microprocessor" is meant any of the small computing devices incorporated in one or more microcircuits which are intended for mounting on a circuit board and have an addressable random access data storage memory (RAM).) The reader who is skilled in the art will realize that a part of a microprocessor which executes the functions of the various elements shown as comprising status recorder 50 in fact comprises each of these elements as its function is performed. The functional relationship and descriptions shown in FIG. 1 for the elements of status recorder 50 provides ample guidance for a person who is skilled in the art to replicate the invention in a microprocessor should (s)he choose this implementation. Each of the blocks shown for status recorder 50 have well known functions, and hardware products are available as well or can be easily devised from available hardware elements for performing these functions. The blocks shown as forming a part of controller 40 will typically also comprise a microprocessor. The elements of controller 40 which interact directly with analyzer 80 are also well known. The structure and operation of analyzer 80 is explained and discussed in connection with FIG. 3. Lastly, the symbol "=>" used at various points throughout FIGS. 1 and 3 has the conventional meaning of "implies" or "results from". Thus, in connection with count test element 67, the legend "1 =>=" means that path 58 carries a logical 1 signal when the count accumulated in counter 65 equals 255.

A signal converter 51 receives the status signals on paths 38 from the voltage sensors, and provides on path 52 a first out signal encoding the identification number for the current first open switch if there is one. Other formats for encoding the identity of the first out interlock switch are also possible. When load 19 is in its normal operating mode, all of the switches comprising the series circuit 15 are closed, meaning that there is no first open switch. In this situation for the example shown, the signal converter 51 provides a first out signal encoding an identification number of seven as an "all closed" value, although any value different from every switch identification number may be used. The structural details of the signal converter 51 are not important, and there are a number of well-known ways by which this element may be implemented.

The first out signal is provided as an input to a first out register 55. The identification number encoded in the first out signal is recorded in the first out register 55 when a RESET signal on path 76 is applied to the gate of register 55. Register 55 provides the identification number recorded in it in a first out register signal on path 53. An equality tester 58 receives the identification numbers encoded in the first out register signal on path 53 and the first out signal on path 52. If the identification numbers received by equality tester 58 on paths 52 and 53 are equal as they usually are, then a signal provided on path 59 to an OR gate 62 by equality tester 58 has a logical 0 value. If the identification numbers received by tester 58 from signal converter 51 and register 55 are unequal, then tester 58 provides a logical 1 signal as the signal on path 59 to OR gate 62.

A second input to OR gate 62 is provided by a count tester 67. At all times while history of the switches' status is being recorded, an elapsed time value (TIME) during which the first out register 55 contents remain unchanged, is accumulated in a counter 65. Counter 65 contains a value which is incremented in response to level changes occurring at fixed intervals in a clock signal from oscillator 64. In my preferred embodiment, the interval between these changes is 8 ms., which I have found to provide sufficient accuracy without an excessive number of bits to record these time values, but other interval lengths are suitable also. Counter 65 is cleared by a logical 1 signal on its clear (CLR) terminal when the RESET signal on path 76 has a logical 1 value. The contents of counter 65 is supplied to the input of a test element 67 which tests the value stored by counter 65 to be equal to 255. This value is also arbitrary, and is chosen simply because it is the maximum value which can be stored by eight bits. If the contents of counter 65 are equal to 255, then a logical 1 signal is applied to a second input of OR gate 62.

Figures 2, 4:
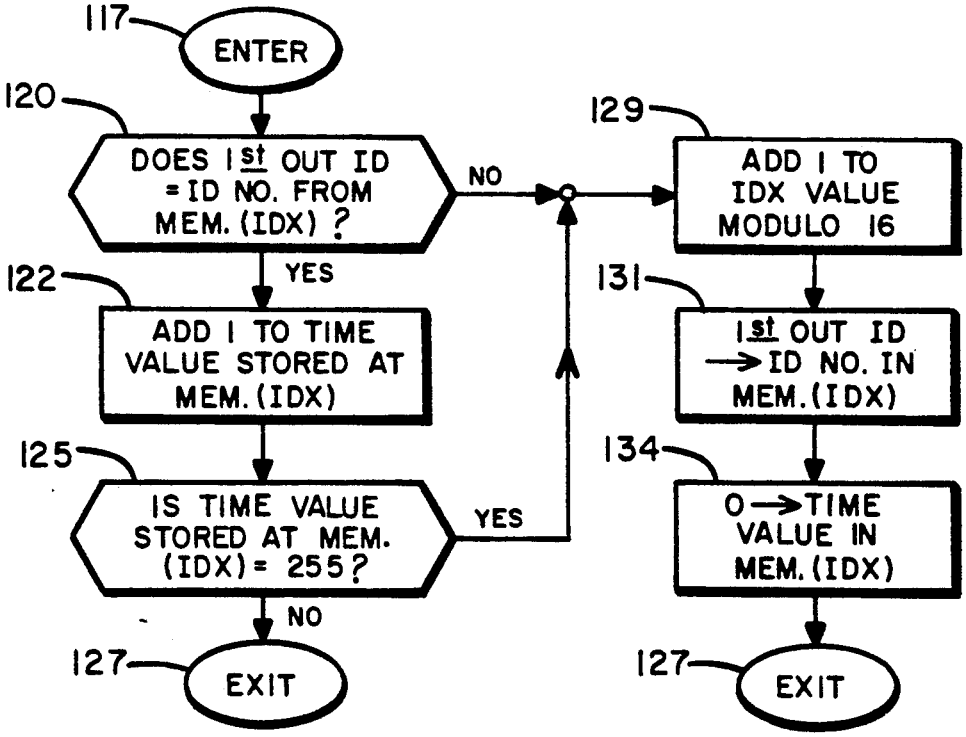
FIG. 2 shows the arrangement of the data in the memory of the status recorder.
FIG. 4 is a flow chart of software code which may be executed by a suitable microprocessor to implement an alternate process for recording status information in a memory of the microprocessor.

The output of OR gate 62 is a status change signal, which has a number of purposes within this apparatus. The status change signal is applied to a load (LD) terminal to condition a memory 69 to accept a history entry comprising the contents of the first out register 55 and the counter 65. FIG. 2 shows the organization of memory 69. In my embodiment, there are locations in memory 69 for 16 history entries, each location having fields for recording an identification number (ID NO) field and a time stamp (TIME) field. Each memory location has its own sequential index assigned to it. Memory 69 is addressed such that individual entries are loaded into sequentially indexed locations, with circular or closed indexing where index 0 location following the index 15 location. The initial value of the index is not important because of this circular sequencing of location indices while loading history entries into memory 69. Each successive status change signal causes memory 69 to store the current contents of counter 65 and first out register 55 in the location immediately following the location where the previous history entry was stored. Individual history entries are provided responsive to a read (RD) signal, by memory 69 on path 70 in a history signal encoding the values of the first out register contents and counter contents which form the history entries. Individual entries may be retrieved by a read signal encoding the index values of these entries. Those with familiarity with the art realize that this organization of memory 69 is completely conventional.

The status change signal is also applied to the input of a delay element 74 which provides the reset signal on path 76 a short time after the status change signal appears. The delay in delay element 74 need only be long enough to allow the history entry to be recorded by memory 69 before the reset signal causes the contents of first out register 55 to possibly change by gating in a new first out identification number, and the contents of counter 65 to change by being cleared from some typically non-zero value (zero is possible but unlikely) to zero. The first out register contents will not change of course if the status change signal arose from the counter 65 contents reaching 255.

The effect of the two conditions which produce logical 1 inputs to OR gate 62 is to cause memory 69 to record, with 8 msec. accuracy, the length of time a particular switch status persists before changing. If the switch status exists unchanged for $256 \times 8$ msec. = approximately 2 sec. or more from the time of the previous reset signal, then a history entry having 255 in the TIME field and its ID NO field equal to the number on path 53 results. This is in fact a common situation. During normal run mode of the load 19, each of the interlock switches will be closed, with the result that the first out signal on path 52 has the all closed value of 7 for an extended interval. Memory 69 will fill up with history entries each of the form 7 255 for the ID NO and TIME fields respectively. Even during a typical startup phase of operation, it is expected that at some point well before run mode is entered all of the interlock switches will have closed. It can be seen that with this configuration for memory 69, after approximately 32 sec. of stability in the interlock switch status, all of the memory locations will contain 7 255.

The history entries are supplied to an analyzer 80 on path 70 for use in determining the likely source for a fault detected in the operation of load 19. The analyzer 80 and the status recorder 50 together with a display unit comprise an expanded annunciator system which cooperates with a controller 40 in assisting the operator of the installation comprising load 19 in diagnosing operating faults.

Many of the components shown as comprising controller 40 are typically also implemented by programming a suitable microprocessor. Controller 40 includes a load control element 42 which provides control signals to load 19 which control its operation. Voltage applied to load 19 through interlock switches 15 from power terminal is sensed by a voltage sensor 25 which provides a logic level interlock signal on path 26 having first and second values as load power is and is not present on path 24. Presence of voltage at a selected point within load 19 may also be supplied to fault sensor 43 as a logic level signal by voltage sensor 28. The signals on paths 26 and 29 are collectively referred to as load status signals.

A request generator element 43 receives the control signals from load control element 42 and the load status signals. If at any time the load status signals do not agree with the values expected for the current configuration of the control signals, this is interpreted by the request generator 43 as a fault condition, and a request signal is provided to a one-shot 44 which in response provides a short signal to the set (S) terminal of a flip-flop 36 as well as to the clear (CLR) input of a request timer 47. A request signal starts the process by which a first out switch as of the time of the request signal is identified. Request signals may be provided for reasons other than faulty operation of the load 19, according to some preselected condition which occurs within request generator 43, but which arises for example because of operator input to controller 40. When set, flip-flop 36 provides on its Q output terminal a request (REQ) signal carried on path 46 to a transmit delay block 41 and a error detection code (EDC) element 45. The request timer 47 has an internal request time value which is incremented at preselected intervals and encoded in a request time signal which specifies the time elapsed since the request condition was detected by request generator 43.

Controller 40 does not make any determination as to the status of the switches at the time of the request. Instead the request and the request time signals are sent to analyzer 80 via a communication bus and are used by it to select information in memory 69 which records the switch status at the time of the request. In my commercial embodiment this data transmission occurs via a serial data path shared with at least one display unit, and possibly with a number of other devices as well. The use of a shared serial data path simplifies installation, and the receiver/transmitters for performing these transmissions are widely available, reliable, and cheap. Use of a shared serial data bus however, creates essentially random delays in the communication of data between analyzer 80 and controller 40. These delays arise most frequently because of conflicts in the use of the data path. To simplify the explanation of the embodiment, I have shown the data link between controller 40 and analyzer 80 as comprising parallel data paths for each type of data transmitted, with a transmission delay block 41 interposed therein to represent these delays. The request signal carried on data path 46 is represented in FIG. 1 as available, delayed in time, to analyzer 80 on data path 46'. The request time signal carried on path 48 is provided to analyzer 80 on data path 48' under similar conditions.

To assure accuracy of the data provided to analyzer 80, it is customary to append an error detection code to the end of each message. A simple sum check is usually adequate for the non-critical information involved here. The EDC element 45 receives the request and request time signals, as well as any other data included in the message to analyzer 80 and shown as the input on path 37, and forms an error detection code from all of the bytes which form preceding parts of the message. EDC element 45 provides a error detection code signal on path 49 which is also transmitted through the transmit delay block on the serial path and is carried on path 49' to analyzer 80. The EDC signal is used as an end of message (EOM) signal by analyzer 80.

The contents of request timer 47 are supplied also to a test element 35 which provides a logical 1 output to one input of an OR gate 38 when the request time exceeds some preselected value shown as 255 in FIG. 1. The time uses by test element 35 puts a maximum limit on the time during which the message can be sent to analyzer 80 and the first out switch identification completed. The OR gate 38 also receives an answer (ANS) signal on path 101' from analyzer 80. When a logical 1 is present at either input of OR gate 38, a logical 1 output is provided which resets flip-flop 36 and changes the request signal from a logical 1 to a logical 0.

Figure 3:
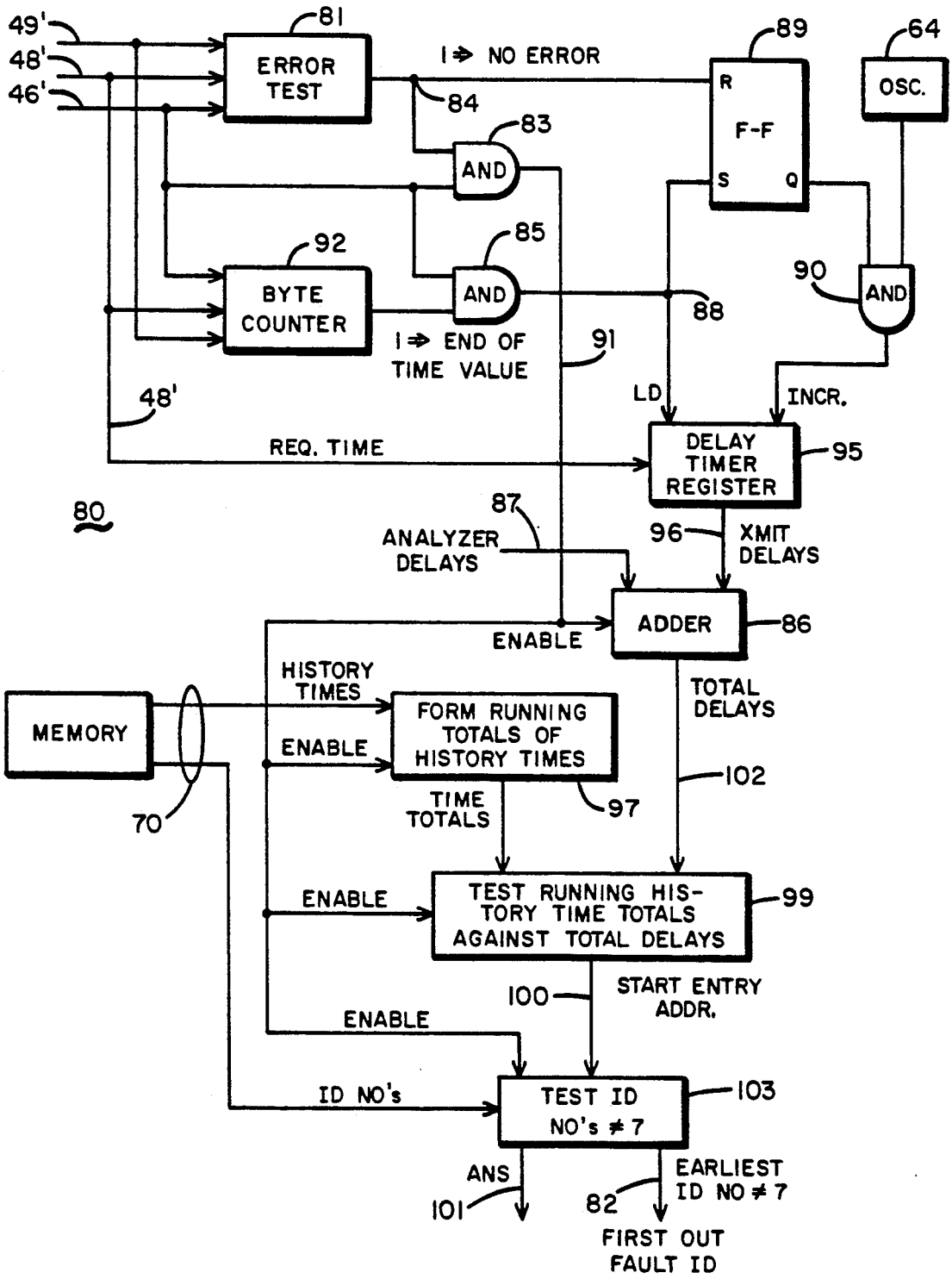
FIG. 3 is a block and logic diagram of the analyzer block of FIG. 1 which determines the first out switch status at the time of a request signal.

Structure and operation of analyzer 80 are defined in FIG. 3. Because of the variability of the delays in transmitting the request and request time signals to analyzer 80, it is necessary to use the value encoded in the request time signal in selecting the proper history entry in memory 69. But there is also an appreciable delay while the message itself is sent, and there are synchronization and other internal delays within analyzer 80 itself for which account must be made in the history entry selection process to accurately determine the switch status at the time the request condition was detected.

At the instant that the last of the request time signal is received by analyzer 80, the request time is provided on path 48' to one input of a delay timer register 95, and gated into register 95 by a logical 1 signal on path 88. The end of the request time portion of the message on path 48' is sensed by a byte counter 92 which simply counts each byte in the message and when the byte containing the last of the request time is received, places a logical 1 signal on the output connected to the input of an AND gate 85 as indicated by the legend on the output of byte counter 92. Of course, there are other ways which may be used to determine the end of the request time signal. The request signal on path 46' forms a second input to AND gate 85. The output of AND gate 85 is provided to the set (S) input of a timer flip-flop 89 and to the load (LD) gate of delay timer register 95. When set, flip-flop 89 provides an enable signal to an AND gate 90 which starts register 95 incrementing at the rate of oscillator 64. The output of AND gate 85 applied to the LD terminal of register 95 preloads register 95 with the request time value carried on path 48'. The current contents of register 95 thus closely track the total time elapsed since the request generator 43 provided the current request signal.

I use the successful completion of an error detection test as an end of message signal whose occurrence enables selection of a history entry. An error test element 81 receives the entire message sent to analyzer 80, recalculates the EDC, and tests the recalculated EDC against the EDC received at the message end. If the two EDC values agree, then a logical 1 signal is placed on path 84. The logical 1 signal on path 84 is applied to the reset (R) terminal of flip-flop 89, whose "Q" output changes from a logical 1 to a logical 0 in response. The logical 0 from flip-flop 89 disables AND gate 90, which stops time accumulation in register 95. At this point, register 95 contains a time value which is quite close to the actual time which has elapsed since the request signal was first provided by one-shot 44.

The output of error test element 81 is also provided to one input of an AND gate 83. The second input of AND gate 85 is provided by the request signal on path 46'. When both of these inputs have a logical 1, then the AND gate 83 inputs are satisfied, and a logical 1 signal is generated on path 91. This logical 1 signal on path 91 forms an enable signal which activates further processing which identifies the first out switch.

The delays arising from the transmission of the data to analyzer 80 are provided from register 95 on path 96 to an adder 86. There are certain other delays associated with the operation of the analyzer itself, and an approximation these are provided to another input of adder 86 on path 87. I say "approximation" because of the fact that these delays are somewhat unpredictably variable, arising from synchronization and other types of delays which arise. As an example of one such delay, because oscillator 64 is not synchronized with the incrementation of the contents of request timer 47 within controller 40, there is the possibility that there may be as much as −8 msec. to +8 msec. error in the value in register 95 arising from this source itself. There will typically be other sources and sizes for errors in such an arrangement, and these will vary from design to design and from occurrence of one request to another. I have found that the maximum sum of such uncertainty in the delays in my design is not large enough to impact the validity of the selection of the history entry from memory 69 and believe that this will be true for most designs. I prefer to perform a worst case analysis of these analyzer delays, and use the maximum possible value for the analyzer delay value provided on path 87. The enable signal on path 91 causes adder 86 to sum the transmission delays and the approximation of the analyzer delays to form an approximation of the total delays between the instant of the request signal and the actual determination of the first out switch. The adder 86 provides a signal on path 102 encoding this approximation. The time required for the operations performed by analyzer 80 after this point are included in the analyzer delays signal on path 87, allowing the value on path 102 to be used to determine the approximate time of the request without further update.

A two step process is used to determine the first out status of interlock switches 14 and 15 as of the time the request is detected. In the first step, a running total element 97 receives the TIME entries encoded in the history entries from the memory 69 on path 70. Element 97 when enabled by the signal on path 91 sequentially extracts TIME values starting from the most recently stored of the history entries, from memory 69, and forms a running total for each of these TIME values. When the running total which is thus formed exceeds the contents of register 95, this identifies the earliest history entry in which the first out status existing at the time of the request is likely to be found. The memory 69 location containing the history entry of which the TIME entry which creates the running total greater than the value in register 95 is a part, becomes a start entry location whose address is encoded in a signal on path 100.

Test element 103 receives the start entry address encoded in the path 100 signal, and tests whether the ID NO in that entry is not equal to seven. If not equal to seven, then this means that at this point in time, at least one of the switches 14 and 15 were open, and this condition is communicated with an answer (ANS) signal on path 101 and by encoding the ID NO value just tested by element 103 in the first out request ID signal on path 82. If equal to seven, the ID NO in the history entry recorded immediately following the entry specified on path 100 is extracted from memory 69 and is similarly tested to be unequal to seven. If so, then this ID NO is encoded in the first out request ID signal on path 82 and the answer signal is place on path 101. This procedure continues until an ID NO value unequal to seven is reached or the end of a time interval which may be preselected is reached. The length of this time interval should be selected to assure that all history entries in memory 69 which may be related in time to the request and hold a value different from seven are tested. For example, a 150 msec. window is adequate in a situation where the approximation of the analyzer delays encoded in the signal on path 87 is on the order of 100 msec. If no ID NO value different from seven is found, then seven is encoded in the signal on path 82 and the answer signal is placed on path 101.

As was mentioned earlier, the invention is intended to be embodied in a microprocessor whose constituent elements form the various hardware elements of FIGS. 1-3. Further, there are alternative arrangements for the elements which implement the functions of the invention. In order to show a software-based alternative embodiment of the invention embodied in the elements of FIG. 1 which create the entries in memory 69, FIG. 4 displays a flow chart according to which a program may be prepared and loaded into a suitable microprocessor. The microprocessor thereby becomes the equivalent of this alternative embodiment. The reader will of course understand that there is little difference from a functional standpoint between implementing a particular electronic system in single purpose hardware, as shown in FIGS. 1-3, and performing the same system functions by using a properly programmed microprocessor. In fact, when suitable software is embedded in a microprocessor's read only memory, the microprocessor has in a sense been transformed into single purpose hardware, and such an embodiment is preferred.

The programmed microprocessor which the flow chart of FIG. 4 represents is assumed to have a random access memory (RAM) whose individual locations can be addressed by the various instructions which comprise the software. A block of these locations with sequential addresses is dedicated to holding the first out information which memory 69 of FIG. 1 holds. Another RAM location is dedicated to an index value which may be used by the instructions to designate one of the memory locations as the operand into which data may be loaded and from which data may be read. It is further assumed that the microprocessor has some sort of internal interrupt function, either an explicit hardware function, or a software executive loop which monitors a clock register which increments at a known rate, and in my preferred embodiment, this interrupt occurs at 8 msec. intervals.

The signal converter 51 of FIG. 1 is assumed to provide an identification number (ID NO) of a first out switch. In a microprocessor implementation, each of the status signals becomes an input to the microprocessor, and can be analyzed according to well known techniques to determine the identification number which corresponds to the particular status signal values at a given instant. In the microprocessor implementation, a RAM location is assumed to contain the current ID NO value at all times.

Finally, an explanation about notational conventions used in FIG. 4. The six-sided elements, such as element 120 denote decision elements which represent instructions testing a specified value(s) for a particular condition. Thus, decision element 120 denotes instructions which test for equality between two numeric values and cause instruction execution to follow one or another path depending on the results of the test as indicated by "yes" and "no" labels on two flow lines exiting the block. Activity elements such as shown at 122 denote instructions which cause a specified data manipulation to occur. The instruction which activity element 122 symbolizes causes a value to be incremented by one. There are a number of occasions where the term "MEM(IDX)" is used to refer to the operand within memory 69 specified by the index IDX, i.e., the "IDXth" location in memory 69.

Each time the 8 msec. interval finishes, execution of instructions transfers to connector element 117 to execute the instructions of decision element 120. The current first out ID NO is compared to the ID NO stored in memory 69 at the location specified by the value in the IDX variable. If these values are equal, execution continues with the instructions symbolized by activity element 122, which cause the TIME value in the memory location specified by the IDX variable to be incremented by one. Then the instructions symbolized by decision element 125 are executed. The decision element 125 instructions cause the TIME value in memory 69 specified by the IDX variable to be compared with the value 255, and if not equal, execution of the instructions symbolized by the flow chart of FIG. 4 ends with an exit to other tasks through exit symbol 127.

If the test in decision element 120 was failed or if the test in decision element 125 was passed, execution instead passes after completion of those elements' instructions, to activity element 129 instructions. These instructions increased the IDX value by one modulo 16, where the term "modulo 16" means that adding one to 15 results in a sum of zero. In this way, location 15 in a table in memory 69 having 16 locations is followed in sequence by the table location with an IDX value of zero. The current first out ID NO held in RAM is then loaded by the instructions of activity element 131 into the memory 69 location specified by the current IDX value. The instructions of activity element 131 are executed following the instructions of activity element 129. The execution of the activity element 134 instructions follow, which sets the TIME value in the memory 69 location specified by the IDX variable to zero. Again, execution of instructions branches to other tasks through the exit symbol 127.

One can see, that after a maximum of 16×256 ×8 msec.=32.8 sec., a stable interlock switch status results in all 16 of the memory 69 locations being equal to each other. One can also see that after each change in interlock switch status, a new interlock switch identification number is loaded into the memory 69 location holding the oldest history entry, and its TIME value is incremented at 8 msec. intervals. In this way, a short term history of the interlock switch status is constantly maintained with 8 msec. sample accuracy. For the electromechanical switches carrying 50 or 60 hz power that are involved here, this is adequate for determining the status of the interlock switches even several seconds after a request is made.

I claim:

1. A status recorder for recording a status history of a plurality of interlock switches each having a pair of contacts, said contacts connected by a plurality of conductors to form a series circuit of interlock switches in a preselected sequence, said series circuit for connection to pass current from a power source to a load and having a first out status value representing the conductive status of the switches, and including a plurality of voltage sensors each associated with an interlock switch, and each voltage sensor connected to a conductor connected to the interlock switch with which the voltage sensor is associated and providing a status signal having a first state responsive to presence of power voltage on the conductor to which it is connected and a second state otherwise, and further comprising a) signal selector means receiving the status signals for providing a selector signal encoding the first out status value of the interlock switches;

b) a first out register receiving the selector signal and a status change signal, recording as its contents information encoded in the selector signal responsive to the status change signal, and providing a first out register signal encoding the contents of the first out register, c) an oscillator issuing a clock signal having level changes at preset intervals;

d) a counter storing a time stamp value, receiving the clock signal, changing the time stamp value by a predetermined amount responsive to each level change in the clock signal, and providing a time stamp signal encoding the time stamp value;

e) status change sensing means receiving the selector signal and the first out register signal for comparing the information encoded in the selector signal and the first out register signal, and responsive to disagreement therebetween, providing the status change signal; and f) a memory receiving the status change signal, the first out register signal, and the time stamp signal, for sequentially recording responsive to each status change signal, a history entry comprising the information encoded in the first out register signal and the time stamp value encoded in the time stamp signal, and for providing a history signal encoding recorded history entries.

2. The status recorder of claim 1, wherein each of said interlock switches has assigned to it a unique identification code, and each voltage sensor has assigned to it the identification code of its associated interlock switch, wherein the signal selector means further comprises a signal converter means receiving the status signals from the voltage sensors for encoding in the selector signal the identification code of an interlock switch with which is associated a voltage sensor currently providing a status signal having the second state and connected to the contact of a switch also having a contact connected through a conductor to a voltage sensor providing a status signal having the first state; wherein the first out register includes means for encoding in the first out register signal, the identification code of the interlock switch encoded in the selector signal; and wherein the memory comprises means recording the identification code encoded in the first out register signal.

3. The status recorder of claim 2, wherein the counter includes means for setting the time stamp value to a preselected value responsive to a reset signal, and further comprising reset means receiving the status change signal for thereafter issuing the reset signal responsive thereto.

4. The status recorder of claim 1, wherein the counter includes means for setting the time stamp value to a preselected value responsive to a reset signal, and further comprising reset means receiving the status change signal for thereafter issuing the reset signal responsive thereto.

5. The status recorder of claim 4 further comprising means receiving the time stamp signal, for providing a maximum count signal responsive to the time stamp value encoded in the time stamp signal equalling a preselected value, and wherein the status change sensing means receives the maximum count signal and further issues a status change signal responsive to the maximum count signal.

6. A system including the status recorder of claim 2, wherein the memory includes a plurality of storage locations, each storage location recording a single history entry, said system further comprising a controller including i) request means for providing a request signal responsive to a preselected controller condition and ii) a request timer receiving the request signal, storing and updating at a preselected rate a request time value specifying the time currently elapsed since the request signal was provided, and providing a request time signal encoding the current request time value, wherein the status recorder cooperates with an analyzer, said analyzer providing a first out fault identification signal and comprising a) a delay timer means receiving the request time signal for recording and updating a delay time value at the preselected rate of the request timer, for forming the sum of the delay time value and the request time value, and for providing a transmit delay time signal encoding a transmit delay time value equaling at least said sum; and b) entry selection means receiving the transmit delay time signal and the history entries encoded in the history signal, for selecting on the basis of a comparison of the time stamp values in the history entries with the transmit delay time value, at least one history entry recorded in the memory and for encoding the identification code recorded in one of said selected history entries, in the first out fault identification signal.

7. The system of claim 6 wherein the request means includes means for including in the request signal an end of message signal following in time the request time value portion of the request time signal, and wherein the delay timer means includes a delay timer register receiving the end of message signal and the request time signal, recording the request time value in the request time signal as the initial contents of the delay timer register, and ceasing update of the delay timer register responsive to the end of message signal.

8. The system of claim 6, wherein the entry selection means includes means for selecting a sequence of history entries, the first of which was recorded before the request signal and the last of which was recorded after the request signal, and for encoding in the first out fault identification signal one of the identification codes recorded in the sequence of selected history entries and differing from an adjacent history entry's identification code.

9. The system of claim 8, wherein the signal converter means includes means for encoding in the selector signal a preselected all closed value responsive to all status signals having their first state, and wherein the entry selection means comprises means for encoding in the first out fault identification signal, the identification code encoded in one of the sequence of selected history entries.

10. The system of claim 8, wherein the delay timer means further comprises means for providing a transmit delay time signal encoding a transmit delay time value equalling the sum of the delay time value, the request time value, and a predetermined analyzer delay value.

11. The system of claim 6, wherein the controller includes a nonvolatile memory receiving the first out fault identification signal and recording the identification code encoded therein.

12. The system of claim 6, wherein the request means of the controller includes means receiving an answer signal and responsive thereto, for ending the request signal, and wherein the entry selection means of the analyzer includes means for supplying the answer signal responsive to selecting a history entry.

13. A method for recording in a microprocessor memory having a plurality of addressable storage locations, a status history of a plurality of interlock switches, each interlock switch having a pair of contacts, said contacts connected by a plurality of conductors to form a series circuit of interlock switches in a preselected sequence, said series circuit for connection to pass current from a power source to a load, and having a first out status value representing the conductive status of at least a selected plurality of the switches, said series circuit further including a plurality of voltage sensors each associated with an interlock switch, and each voltage sensor connected to a conductor connected to the interlock switch with which the voltage sensor is associated and providing a status signal having a first state responsive to presence of power voltage on the conductor to which it is connected and a second state otherwise, said method comprising in the microprocessor, the steps of a) recording in the microprocessor memory location specified by an index recorded in a memory index location, the information currently encoded in at least one selected status signal;

b) issuing a clock signal having level changes at preset intervals;

c) responsive to each level change in the clock signal, incrementing a time stamp value recorded in the memory at the location specified by the index; and d) responsive to each level change in the clock signal, comparing the information currently encoded in each selected status signal and the status signal information recorded in the memory location specified by the index, and responsive to disagreement therebetween, incrementing the index, and then recording the information currently encoded in each selected status signal in the microprocessor memory location specified by the index and setting to a preselected value the time stamp value recorded in the memory at the location specified by the index.

14. The method of claim 13, including the step of comparing a preselected value with the time value recorded in the memory at the location specified by the index, and if equal thereto incrementing the index, and then recording the information currently encoded in each preselected status signal in the microprocessor memory location specified by the index and setting to a preselected value the time stamp value recorded in the memory at the location specified by the index.

15. The method of claim 14, wherein the index incrementing step includes the step of adding one of $-1$ and $+1$ constants to the index, modulo a preselected constant value.

16. The method of claim 13, wherein the index incrementing step includes the step of adding one of $-1$ and $+1$ constants to the index, modulo a preselected constant value.

17. The method of claim 13, wherein the status signal recording step includes the step of assigning a unique identification number to each voltage sensor, receiving the status signals provided by a plurality of the voltage sensors, sensing the state of each of a pair of status signals provided by voltage sensors connected to different contacts of the same switch, and recording in the memory as the information currently encoded in at least one preselected status signal, the identification number of one of said voltage sensors.

* * * * *

UNITED STATES PATENT AND TRADEMARK OFFICE

CERTIFICATE OF CORRECTION

PATENT NO. : 5,329,273

DATED : July 12, 1994

INVENTOR(S) : Paul B. Patton

It is certified that error appears in the above-identified patent and that said Letters Patent is hereby corrected as shown below:

Column 13 (claim 1), line 43, delete "," insert ";".

Column 15 (claim 7), line 4, after "," insert "updating the delay timer register contents,".

Signed and Sealed this

Eleventh Day of October, 1994

*Attest:*

Bruce Lehman

BRUCE LEHMAN

*Attesting Officer*

*Commissioner of Patents and Trademarks*